US010597845B2

(12) United States Patent
Kenkel et al.

(10) Patent No.: US 10,597,845 B2
(45) Date of Patent: Mar. 24, 2020

(54) IMPLEMENT VIBRATION SYSTEM AND METHOD

(71) Applicant: Deere & Company, Moline, IL (US)

(72) Inventors: Aaron R. Kenkel, East Dubuque, IL (US); David J. Myers, Dubuque, IA (US); Timothy K. Dreger, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 149 days.

(21) Appl. No.: 15/717,108

(22) Filed: Sep. 27, 2017

(65) Prior Publication Data

US 2019/0093310 A1 Mar. 28, 2019

(51) Int. Cl.
*E02F 3/407* (2006.01)
*E02F 3/42* (2006.01)
(Continued)

(52) U.S. Cl.
CPC ..... *E02F 3/407* (2013.01); *B06B 1/18* (2013.01); *E02F 3/422* (2013.01); *E02F 9/2004* (2013.01); *E02F 9/2228* (2013.01); *F15B 11/08* (2013.01); *E02F 3/34* (2013.01); *F15B 15/088* (2013.01); *F15B 15/20* (2013.01); *F15B 2211/30525* (2013.01); *F15B 2211/327* (2013.01); *F15B 2211/328* (2013.01); *F15B 2211/665* (2013.01); *F15B 2211/6658* (2013.01); *F15B 2211/7053* (2013.01); *F15B 2211/7733* (2013.01)

(58) Field of Classification Search
CPC ..... E02F 3/407; E02F 9/2228; E02F 9/2004; E02F 3/422; E02F 3/34; B06B 1/18; F15B 15/20; F15B 15/088
See application file for complete search history.

(56) References Cited

U.S. PATENT DOCUMENTS 5,235,809 A 8/1993 Farrell
7,117,952 B2 10/2006 Bares et al.
(Continued)

FOREIGN PATENT DOCUMENTS

EP 2557238 A1 2/2013

*Primary Examiner* — Yuen Wong
(74) *Attorney, Agent, or Firm* — Taft Stettinius & Hollister LLP; Stephen F. Rost

(57) ABSTRACT

An implement vibration system and method is disclosed that includes a vibration activation device; an electrohydraulic mechanism and a controller. The controller monitors the vibration activation device and sends movement signals to the electrohydraulic mechanism to control implement movement. When the vibration activation device is activated, the controller sends vibration signals to the electrohydraulic mechanism to cause the implement to vibrate. An operator control can send implement commands where the movement signals are based on the implement commands, and when vibration is activated the controller can superimpose the vibration signals on the movement signals. The vibration signals can cause a hydraulic cylinder to repeatedly extend and retract. An electrohydraulic control valve can receive the movement signals and control hydraulic flow to the hydraulic cylinder based on the movement signals. The vibration signals can be complementary signals. The amplitude and/or frequency of the vibration signals can be adjustable.

20 Claims, 3 Drawing Sheets

(51) Int. Cl.

| | |
|---|---|
| ***E02F 9/20*** | (2006.01) |
| ***B06B 1/18*** | (2006.01) |
| ***E02F 9/22*** | (2006.01) |
| ***F15B 11/08*** | (2006.01) |
| *F15B 15/08* | (2006.01) |
| *E02F 3/34* | (2006.01) |
| *F15B 15/20* | (2006.01) |

(56) References Cited

U.S. PATENT DOCUMENTS

| | | | | |
|---|---|---|---|---|
| 8,869,520 | B2 | 10/2014 | Vigholm et al. | |
| 9,556,589 | B2 | 1/2017 | Brooks et al. | |
| 2006/0085096 | A1* | 4/2006 | Peterson | E02F 3/405 700/280 |
| 2010/0242464 | A1* | 9/2010 | Vigholm | E02F 9/2228 60/327 |

* cited by examiner

IMPLEMENT VIBRATION SYSTEM AND METHOD

FIELD OF THE DISCLOSURE

The present disclosure relates to electrohydraulic machinery with an implement, and more particularly to vibrate the implement based on vibration parameters.

BACKGROUND

In an implement control system on a material handling vehicle (such as a 4WD Loader), specific applications require the ability for an operator to "meter" (or dump with fine precision) material out of a bucket. In a direct (manually) controlled or pilot operated hydraulic system, valve response is often good enough for an operator to do this by shaking the control lever to shake or vibrate the bucket. In an Electro-Hydraulic (EH) system, however, control dampening and rate limiting, coupled with longer valve response times, can make this more difficult to do by shaking a control lever.

It would be desirable to have a feature that enables a vehicle operator to shake or vibrate an implement to better control the implement function.

SUMMARY

An implement vibration system is disclosed for a vehicle having an implement. The implement vibration system includes a vibration activation device; an electrohydraulic mechanism and an electronic controller. The electrohydraulic mechanism controls movement of the implement. The electronic controller monitors the vibration activation device and sends movement signals to the electrohydraulic mechanism to control movement of the implement. When the vibration activation device is activated, the electronic controller sends vibration signals to the electrohydraulic mechanism to cause the implement to vibrate.

The vehicle can further include an operator control that enables the operator to send implement commands to control movement of the implement. The movement signals sent by the controller to the electrohydraulic mechanism would be based on the implement commands; and, when the vibration activation device is activated, the electronic controller can superimpose the vibration signals on the movement signals sent to the electrohydraulic mechanism. The electrohydraulic mechanism can include a hydraulic cylinder that controls movement of the implement, and the vibration signals can cause the hydraulic cylinder to repeatedly extend and retract. The electrohydraulic mechanism can also include an electrohydraulic control valve that receives the movement signals from the controller and controls hydraulic flow to extend and retract the hydraulic cylinder in accordance with the movement signals. The electrohydraulic control valve can include first and second solenoids that receive the movement signals and control position of the electrohydraulic control valve; and the vibration signals can include a first signal sent to the first solenoid and a second signal sent to the second solenoid. The first and second signals can be complementary signals. The first and second signals can be square waves, sinusoidal waves, sawtooth waves or other waveforms. At least one of the amplitude and frequency of the vibration signals can be adjustable.

An alternative implement vibration system for a vehicle having an implement is disclosed where the implement vibration system includes an operator control, a shake detection device, an electrohydraulic mechanism and an electronic controller. The operator control enables the operator to send implement commands to control movement of the implement. The shake detection device is coupled to the operator control, and generates motion signals to indicate movement of the operator control. The electrohydraulic mechanism controls movement of the implement. The electronic controller receives the implement commands and the motion signals, and sends movement signals to the electrohydraulic mechanism to control movement of the implement where the movement signals are based on the implement commands. When the motion signals exceed a motion threshold, the electronic controller superimposes vibration signals on the movement signals sent to the electrohydraulic mechanism to cause the implement to vibrate. The vibration detection device can be a motion sensor. The electronic controller can monitor amplitude and frequency of operator movement of the operator control based on the motion signals, and the motion threshold can include an amplitude threshold and a frequency threshold.

An implement vibration method is disclosed for a vehicle having an implement. The method includes monitoring a vibration activation device; controlling movement of the implement with an electrohydraulic mechanism; and when the vibration activation device is activated, sending vibration signals to the electrohydraulic mechanism to cause the implement to vibrate.

The vehicle can include an operator control that enables the operator to send implement commands to control movement of the implement; and the method can further include sending movement signals to the electrohydraulic mechanism based on the implement commands; and when the vibration activation device is activated, superimposing the vibration signals on the movement signals sent to the electrohydraulic mechanism. The electrohydraulic mechanism can include a hydraulic cylinder that controls movement of the implement, and sending vibration signals to the electrohydraulic mechanism to cause the implement to vibrate can include repeatedly sending an alternating sequence of extension and retraction signals to the electrohydraulic mechanism, where the extension signals cause the hydraulic cylinder to extend and the retraction signals cause the hydraulic cylinder to retract. The electrohydraulic mechanism can also include an electrohydraulic control valve that receives the movement signals and controls hydraulic flow to the hydraulic cylinder; and repeatedly sending an alternating sequence of extension and retraction signals can include repeatedly sending the alternating sequence of extension and retraction signals to the electrohydraulic control valve, where the extension signals cause the electrohydraulic control valve to increase flow to a first side of the hydraulic cylinder to extend the hydraulic cylinder, and the retraction signals cause the electrohydraulic control valve to increase flow to a second side of the hydraulic cylinder to retract the hydraulic cylinder. The electrohydraulic control valve can include first and second solenoids that receive the movement signals and control position of the electrohydraulic control valve; and sending vibration signals to the electrohydraulic mechanism to cause the implement to vibrate can include sending a first signal to the first solenoid; and sending a second signal to the second solenoid. Monitoring a vibration activation device can include receiving motion signals from a sensor indicating movement of the operator control; and activating the vibration activation device when the motion signals exceed a motion threshold.

The method can also include monitoring a vibration signal adjustment control that enables the operator to select parameters of the vibration signals; and when the vibration activation device is activated, generating the vibration signals based on the selected parameters. Monitoring a vibration signal adjustment control can include monitoring an amplitude control that enables the operator to select an amplitude for the vibration signals and/or monitoring a frequency control that enables the operator to select a frequency for the vibration signals.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
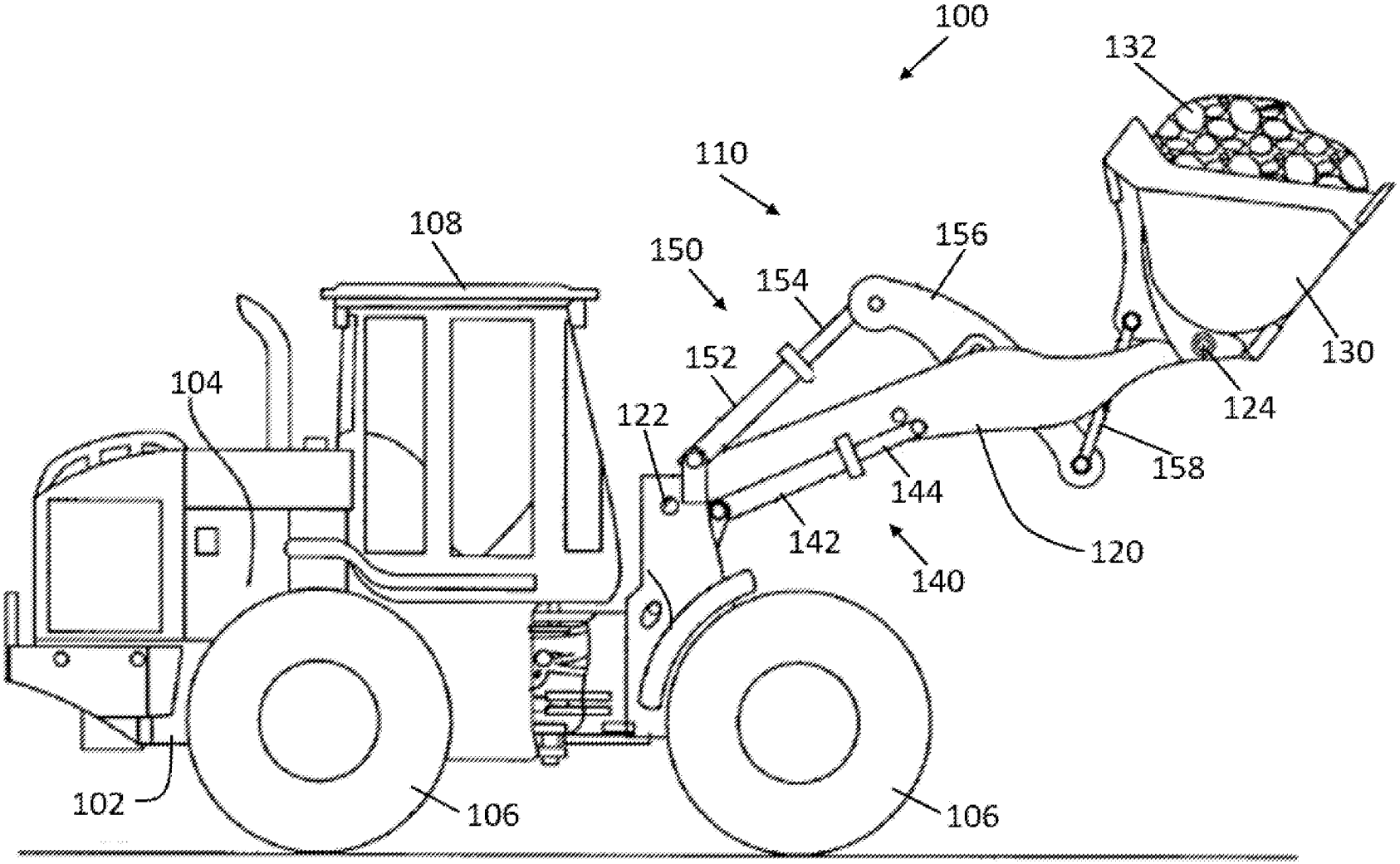
FIG. 1 illustrates an exemplary work vehicle shown as a loader.

FIG. 1 illustrates an exemplary work vehicle shown as a loader 100 that includes a frame 102, an engine 104, ground engaging wheels 106, and a loader assembly 110. The wheels 106 are attached to the frame 102 in a manner that allows rotational movement relative thereto. The loader assembly 110 can perform a variety of excavating and material handling functions. An operator controls the functions of vehicle 100 from an operator cab 108.

Loader assembly 110 includes a loader boom 120 and an implement or tool, for example a loader bucket 130. The loader boom 120 has a first end pivotally attached to the frame 102 at a boom pivot 122, and a second end to which the loader bucket 130 is pivotally attached at a bucket pivot 124. The loader assembly 110 also includes a boom actuator 140 which includes a boom hydraulic cylinder 142 having a boom piston rod 144. The boom actuator 140 extends between the vehicle frame 102 and the loader boom 120 and controllably moves the loader boom 120 about the loader boom pivot 122. The loader assembly 110 also includes an implement actuator 150 which includes an implement hydraulic cylinder 152 having an implement piston rod 154. The implement actuator 150 extends between the frame 102 and a bucket orientation control member 156, which together with a pivotally connected linking bar 158, controllably move the loader bucket 130 about the loader bucket pivot 124. The loader bucket 130 is shown holding material 132.

Figure 2:
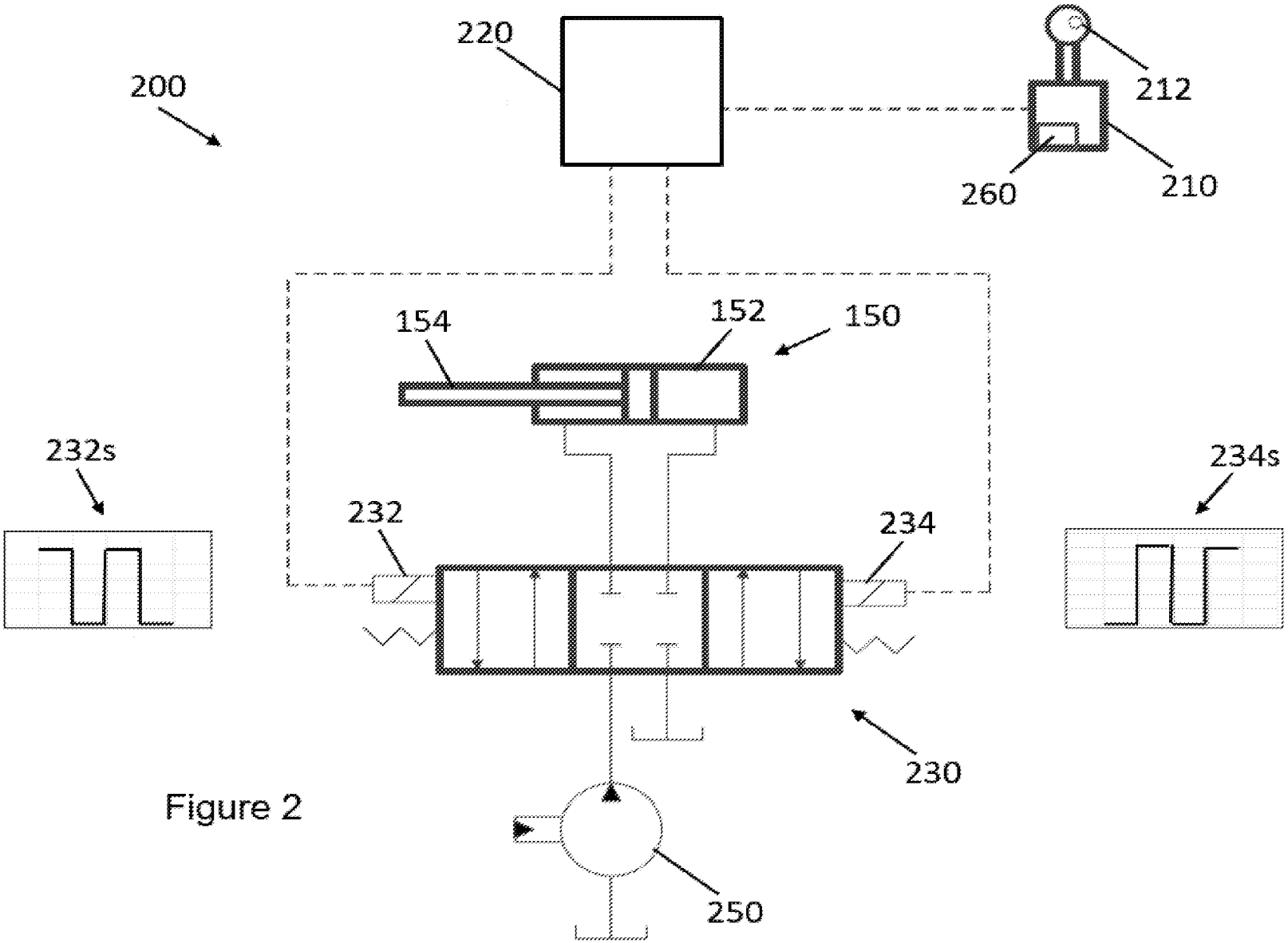
FIG. 2 illustrates is an architecture diagram for an exemplary embodiment of an implement vibration system that can be included in the work vehicle to enable shaking or vibration of the implement.

FIG. 2 is an architecture diagram for an exemplary embodiment of an implement vibration system 200 that can be included in the work vehicle 100 to enable shaking or vibration of the implement 130, for example to meter material 132 out of the bucket 130. The implement vibration system 200 includes an implement control lever 210, an electronic controller 220, an electro-hydraulic (EH) control valve 230, the implement actuator 150 and a hydraulic pump 250. The EH control valve 230 in the exemplary embodiment is a 2-way/3-position valve that controls fluid flow from the pump 250 to the implement actuator 150. The controller 220 sends electrical signals to electric solenoids 232, 234 of the EH control valve 230 to control the position of the EH control valve 230. The operator can use the control lever 210 to send control signals to the controller 220 to control the signals sent to the solenoids 232, 234 of the EH control valve 230.

The implement actuator 150 includes the hydraulic cylinder 152 and the piston rod 154 which can be used to move the bucket 130. The EH control valve 230 includes a first solenoid 232 and a second solenoid 234 that position the EH control valve 230 in one of its three positions. In the first (left) position, flow from the pump 250 is directed by the EH control valve 230 to extend the implement actuator 150. In the second (center) position, the EH control valve 230 blocks flow from the pump 250 to the implement actuator 150. In the third (right) position, flow from the pump 250 is directed by the EH control valve 230 to retract the implement actuator 150.

The control lever 210 can include a vibrate switch or button 212 to activate the vibration feature of the implement vibration system 200. When the vibrate button 212 is pressed, an activate vibration signal is sent from the control lever 210 to the controller 220. The controller 220 then sends electrical signals to the solenoids 232, 234 to cause the EH control valve 230 to "shake" or "vibrate" the implement. The implement could be a loader bucket, or potentially an implement attached to the loader and operated via an auxiliary valve section (like a third function attachment, for example). The vibrate button 212 can be dedicated to this vibration feature, or could be part of a "multi-function" button feature that allows the operator to assign any specific function to it.

FIG. 2 shows sample waveforms 232*s*, 234*s* that can be sent to the solenoids 232, 234, respectively, of the control valve 230. The complementary square waveforms 232*s*, 234*s* will repeatedly move the control valve 230 between the first and third positions which will repeatedly extend and retract the implement actuator 150 causing the implement to shake or vibrate.

When the implement vibration feature is activated, the controller 220 can superimpose the waveform on top of an existing operator implement command. The "waveform" can be superimposed on the operator implement command so that the implement function is allowed to operate normally while this "vibration" mode is turned on. For example, a loader operator could be slowly dumping material from the bucket 130 into a feed hopper, and could use the vibration button 212 to turn the vibration feature on and off. Turning the vibration feature on and off would potentially aid in the process of precisely metering material 132 out of the bucket 130.

The superimposed waveform can have an established amplitude and frequency that is tuned for the specific vehicle it is being used on. The amplitude and frequency of the superimposed waveform can be made adjustable by a vehicle monitor through the use of discrete settings (for example, "Low", "Medium", and "High"), and/or by the ability to adjust the settings through a full proportional range with a dial or other control mechanism. The waveform can have a "square wave" shape or other shapes, for example a sinusoid shape, or a "saw tooth" shape that ramps up and down from a given offset. The waveform can be superimposed on the operator implement command, meaning that an offset (representing the waveform amplitude) is added to and subtracted from the existing operator command at a given frequency.

The superimposed waveforms sent to the solenoids 232, 234 of the control valve 230 can be complementary or have another desired relationship. For example, the waveforms could be close to but not fully complimentary, for example +/−five degrees away from 180 degrees out of phase. This could lead to the two control signals briefly "fighting" each other as they try to shift the spool of the control valve 230 in opposite directions. This would serve to neutralize the main spool momentarily before one of the signals releases it to move the other direction.

An alternate embodiment of a vibration feature could include a "shake detection" feature in the implement control lever 210. This shake detection feature could include a motion sensor 260 on the implement control lever 210 that detects when the operator is moving the implement control lever 210 in a series of motions that would shake the implement. The controller 220 could receive signals from the motion sensor 260 and monitor the amplitude and frequency of the operator input command or motion to the implement control lever 210. The shake detection feature could be activated by the controller 220 when it detects the amplitude and frequency of the operator input command or motion to the implement control lever 210 exceeds a shake threshold. When this operator shake action is detected, the vibration feature could then automatically control vibration of the implement at a predefined command frequency/amplitude.

Figure 3:
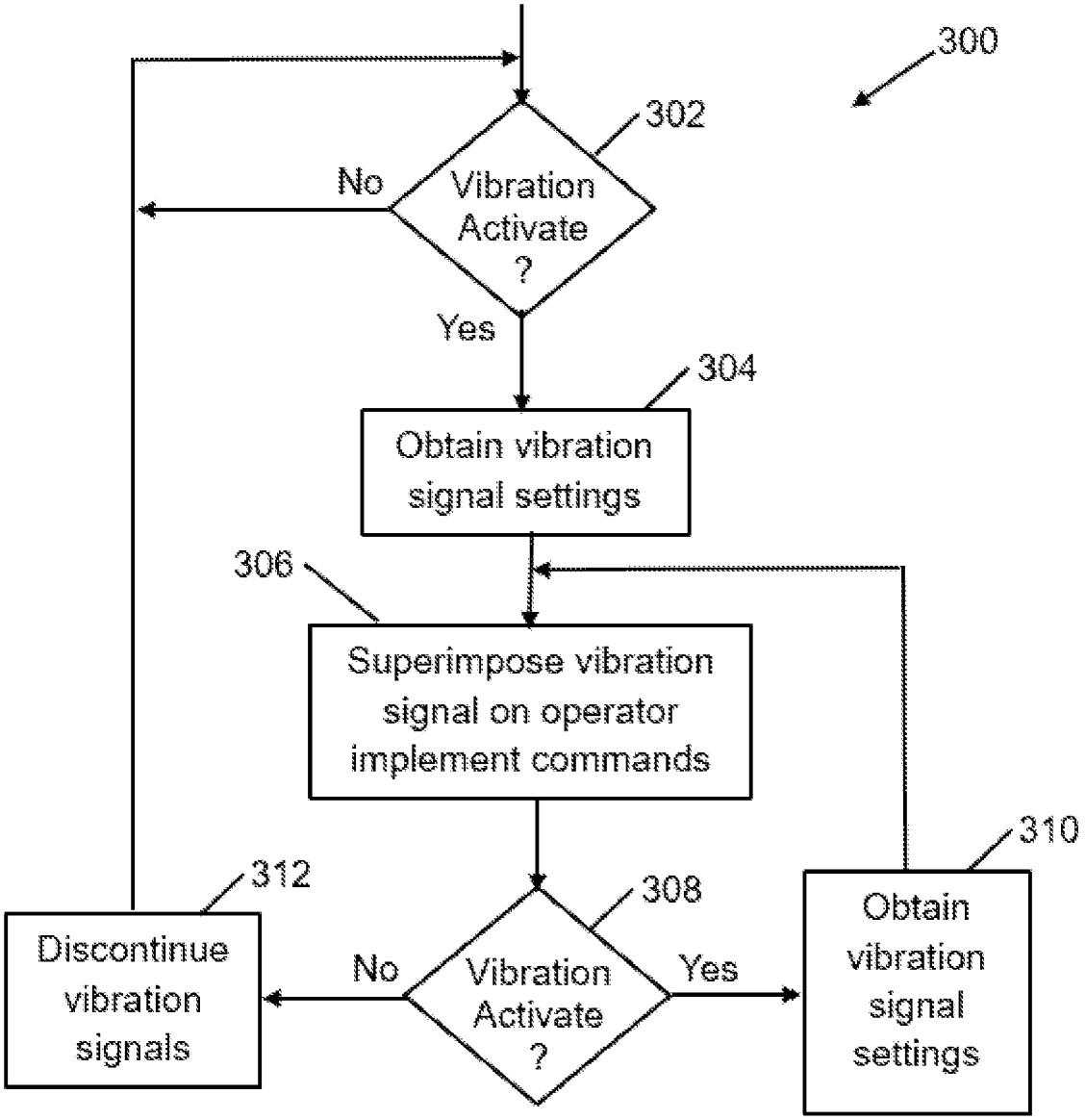
FIG. 3 illustrates an exemplary top level control diagram for an embodiment of a vibration function.

FIG. 3 illustrates an exemplary top level control diagram for an embodiment of a vibration function. The system waits at block 302 for the operator to activate the vibration feature, for example by pressing the vibration button 212. When the vibration feature to be activated, control passes to block 304.

At block 304 the system obtains the settings for the vibration signal. The vibration signal settings (amplitude, frequency, shape, etc.) can be preset for the vehicle, or be selectable from a limited selection, or be adjustable within a range, etc. Then at block 306, the controller superimposes the vibration signal on the existing operator implement commands. If the implement is currently in a neutral position (no current operator implement commands), the vibration signal can be sent to vibrate the implement in place.

The vibration feature remains active and at block 308 checks if the operator has stopped activation of the vibration function, for example by releasing the vibration button 212. If the operator is still activating the vibration feature control passes to block 310. If the operator has stopped activating the vibration feature control passes to block 312.

At block 310, the system checks if any of the vibration signal settings have changed, for example the operator increased the frequency or moved from "Low" to "Medium" setting, etc. Block 310 is not necessary if the vibration settings are not adjustable, or are not adjustable while the vibration feature is active. From block 310 control passes to block 306 where the controller superimposes the vibration signal, with any adjustments, on the existing operator implement commands.

At block 312, the controller discontinues the vibration signal, and control passes to back block 302 to wait for the next time the operator activates the vibration feature.

While the disclosure has been illustrated and described in detail in the drawings and foregoing description, such illustration and description is to be considered as exemplary and not restrictive in character, it being understood that illustrative embodiment(s) have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

We claim:

1. An implement vibration system for a vehicle having an implement, the implement vibration system comprising:

a vibration activation device;

an operator control that enables the operator to send implement commands to control movement of the implement;

an electrohydraulic mechanism that controls the movement of the implement;

an electronic controller that monitors the vibration activation device and sends movement signals to the electrohydraulic mechanism to control movement of the implement;

wherein the movement signals sent by the electronic controller to the electrohydraulic mechanism are based on the implement commands; and wherein when the vibration activation device is activated, the electronic controller sends vibration signals to the electrohydraulic mechanism to cause the implement to vibrate, and superimposes the vibration signals on the movement signals sent to the electrohydraulic mechanism.

2. The implement vibration system of claim 1, wherein the electrohydraulic mechanism comprises a hydraulic cylinder that controls the movement of the implement, and the vibration signals cause the hydraulic cylinder to repeatedly extend and retract.

3. The implement vibration system of claim 2, wherein the electrohydraulic mechanism further comprises an electrohydraulic control valve that receives the movement signals from the electronic controller and controls hydraulic flow to extend and retract the hydraulic cylinder in accordance with the movement signals.

4. The implement vibration system of claim 3, wherein the electrohydraulic control valve includes a first solenoid and a second solenoid that receive the movement signals and control position of the electrohydraulic control valve; and wherein the vibration signals comprise a first signal sent to the first solenoid and a second signal sent to the second solenoid.

5. The implement vibration system of claim 4, wherein the first signal and the second signal are complementary signals.

6. The implement vibration system of claim 1, wherein the vibration signals have amplitude and frequency, and at least one of the amplitude and frequency of the vibration signals is adjustable.

7. The implement vibration system of claim 1, further comprising:

a shake detection device coupled to the operator control, where the shake detection device generates motion signals to indicate movement of the operator control;

wherein the electronic controller receives the implement commands and the motion signals, and when the motion signals exceed a motion threshold, the electronic controller superimposes the vibration signals on the movement signals.

8. The implement vibration system of claim 7, wherein the shake detection device is a motion sensor.

9. An implement vibration system for a vehicle having an implement, the implement vibration system comprising:

a vibration activation device;

an operator control that enables the operator to send implement commands to control movement of the implement;

a shake detection device coupled to the operator control, where the shake detection device generates motion signals to indicate movement of the operator control;

an electrohydraulic mechanism that controls the movement of the implement;

an electronic controller that monitors the vibration activation device, receives the implement commands and the motion signals, and sends movement signals to the electrohydraulic mechanism to control movement of the implement where the movement signals are based on the implement commands; and wherein when the motion signals exceed a motion threshold or the vibration activation device is activated, the electronic controller superimposes vibration signals on the movement signals sent to the electrohydraulic mechanism to cause the implement to vibrate.

10. The implement vibration system of claim 9, wherein the shake detection device is a motion sensor.

11. The implement vibration system of claim 9, wherein the electronic controller monitors amplitude and frequency of operator movement of the operator control based on the motion signals, and the motion threshold comprises an amplitude threshold and a frequency threshold.

12. An implement vibration method for a vehicle having an implement, the method comprising:

monitoring a vibration activation device;

enabling an operator to send implement commands using an operator control to control movement of the implement;

controlling the movement of the implement with an electrohydraulic mechanism;

sending, by an electronic controller, movement signals to the electrohydraulic mechanism based on the implement commands; and when the vibration activation device is activated, superimposing, by the electronic controller, vibration signals on the movement signals sent to the electrohydraulic mechanism to cause the implement to vibrate.

13. The method of claim 12, wherein the electrohydraulic mechanism comprises a hydraulic cylinder that controls the movement of the implement, and wherein sending vibration signals to the electrohydraulic mechanism to cause the implement to vibrate comprises:

repeatedly sending an alternating sequence of extension and retraction signals to the electrohydraulic mechanism, the extension signals causing the hydraulic cylinder to extend and the retraction signals causing the hydraulic cylinder to retract.

14. The method of claim 13, wherein the electrohydraulic mechanism further comprises an electrohydraulic control valve that receives the movement signals and controls hydraulic flow to the hydraulic cylinder; and wherein repeatedly sending an alternating sequence of extension and retraction signals comprises:

repeatedly sending the alternating sequence of extension and retraction signals to the electrohydraulic control valve, the extension signals causing the electrohydraulic control valve to increase flow to a first side of the hydraulic cylinder to extend the hydraulic cylinder, and the retraction signals causing the electrohydraulic control valve to increase flow to a second side of the hydraulic cylinder to retract the hydraulic cylinder.

15. The method of claim 14, wherein the electrohydraulic control valve includes a first solenoid and a second solenoid that receive the movement signals and control position of the electrohydraulic control valve; and wherein sending vibration signals to the electrohydraulic mechanism to cause the implement to vibrate comprises sending a first signal to the first solenoid; and sending a second signal to the second solenoid.

16. The method of claim 15, wherein the first signal and the second signal are complementary signals.

17. The method of claim 12, wherein monitoring a vibration activation device comprises:

receiving motion signals from a sensor indicating movement of the operator control; and activating the vibration activation device when the motion signals exceed a motion threshold.

18. The method of claim 12, wherein the vibration signals have amplitude and frequency, and the method further comprising:

monitoring a vibration signal adjustment control that enables the operator to select parameters of the vibration signals; and when the vibration activation device is activated, generating the vibration signals based on the selected parameters.

19. The method of claim 18, wherein monitoring a vibration signal adjustment control that enables the operator to select parameters of the vibration signals comprises:

monitoring an amplitude control that enables the operator to select an amplitude for the vibration signals.

20. The method of claim 18, wherein monitoring a vibration signal adjustment control that enables the operator to select parameters of the vibration signals comprises:

monitoring a frequency control that enables the operator to select a frequency for the vibration signals.

* * * * *